US010709996B2

(12) United States Patent
Michelsen

(10) Patent No.: US 10,709,996 B2
(45) Date of Patent: Jul. 14, 2020

(54) SPRINKLER TOY

(71) Applicant: Jeff Michelsen, Glendora, CA (US)

(72) Inventor: Jeff Michelsen, Glendora, CA (US)

( * ) Notice: Subject to any disclaimer, the term of this patent is extended or adjusted under 35 U.S.C. 154(b) by 0 days.

(21) Appl. No.: 15/945,503

(22) Filed: Apr. 4, 2018

(65) Prior Publication Data

US 2018/0280821 A1 Oct. 4, 2018

Related U.S. Application Data

(60) Provisional application No. 62/601,887, filed on Apr. 4, 2017, provisional application No. 62/710,692, filed on Feb. 26, 2018.

(51) Int. Cl.

| | |
|---|---|
| ***A63H 23/16*** | (2006.01) |
| ***B05B 17/08*** | (2006.01) |
| ***A63G 31/00*** | (2006.01) |
| *B05B 3/04* | (2006.01) |

(52) U.S. Cl.

CPC ..... *A63H 23/16* (2013.01); *A63G 31/007* (2013.01); *B05B 17/08* (2013.01); *B05B 3/0409* (2013.01)

(58) Field of Classification Search

CPC ..... A63H 23/16; A63G 31/007; B05B 17/08; B05B 3/0409

USPC ..... 446/199; 239/12, 17, 22, 225.1

See application file for complete search history.

(56) References Cited

U.S. PATENT DOCUMENTS 1,521,792 A * 1/1925 Roach ..... B05B 1/3046 239/258
2,030,605 A * 2/1936 Moore ..... B05B 3/00 239/211
2,087,175 A * 7/1937 Voight ..... B05B 3/06 239/255
2,601,655 A * 6/1952 Young ..... B05B 1/267 239/229
3,488,001 A * 1/1970 Donald ..... B05B 3/08 239/229
4,018,386 A * 4/1977 Barichello ..... B05B 3/0472 239/200
4,261,514 A * 4/1981 Kennard ..... A63H 33/28 239/211
4,434,937 A * 3/1984 Pitchford ..... B05B 3/08 239/230
4,537,356 A * 8/1985 Lawson ..... B05B 3/0481 239/230

(Continued)

FOREIGN PATENT DOCUMENTS

AU 6300280 A 4/1981

*Primary Examiner* — Vishu K Mendiratta

(74) *Attorney, Agent, or Firm* — Lincoln Law School of San Jose

(57) ABSTRACT

A sprinkler toy device and method are provided. In use, a flow stream is received at a connector of a sprinkler base. Next, the flow stream is conveyed to a rotatable arm, wherein the rotatable arm allows for 360 degree movement in a first axis direction. Additionally, the flow stream is then conveyed to a flexible tubular member connected to a metal coil, wherein the metal coil allows for movement in a second axis direction, and the flexible tubular member is capable of movement in the first axis direction and the second axis direction. Further, the flow stream is conveyed to one or more objects connected to the flexible tubular member and the flow stream is expelled through one or more spray valves attached to each of the one or more objects.

8 Claims, 4 Drawing Sheets

(56) References Cited

U.S. PATENT DOCUMENTS

| | | | | |
|---|---|---|---|---|
| 5,248,093 | A * | 9/1993 | Pleasants | B05B 3/0454 239/239 |
| 5,366,157 | A * | 11/1994 | Pleasants | B05B 3/0454 239/239 |
| 5,820,472 | A * | 10/1998 | Briggs | A63B 9/00 472/128 |
| 6,095,428 | A | 8/2000 | Wells | |
| 6,250,565 | B1 * | 6/2001 | Ogie | B05B 3/00 239/211 |
| 6,558,223 | B1 | 5/2003 | Matthews | |
| 7,475,832 | B2 | 1/2009 | Amron | |
| 2002/0068502 | A1 * | 6/2002 | Kownacki | A63H 17/00 446/465 |
| 2005/0252988 | A1 * | 11/2005 | Chang | B05B 3/00 239/225.1 |
| 2009/0050835 | A1 * | 2/2009 | Boise | A63H 27/10 251/320 |

* cited by examiner

SPRINKLER TOY

CROSS-REFERENCE TO RELATED APPLICATIONS

This application claims priority to and the benefit of U.S. Provisional Patent Application No. 62/601,887, filed Apr. 4, 2017, entitled "Novelty Sprinkler Toy"; and U.S. Provisional Patent Application No. 62/710,692, filed Feb. 26, 2018, entitled "Novelty Sprinkler," both of which are herein incorporated by reference.

FIELD OF THE INVENTION

The present invention generally relates to water sprinklers, and more particularly to toy mounted water sprinklers.

BACKGROUND

Traditional sprinkler systems may include a vertical shaft with extending arms from the shaft to transport and deliver water. Such assembly may also rotate around the shaft such that the extending arms can move and deliver the water in a rotating fashion. However, adapting such systems to also include mounted toys or entertainment systems may pose issues. For example, the rigidity of the system may create a stationary rotating toy that rotates may otherwise does not move in response to the water pressure. Additionally, such rigidity may pose one or more safety issues with respect to children running through and around the sprinkler system.

There is thus a need for overcoming these and/or other issues associated with the prior art.

SUMMARY

A sprinkler toy device and method are provided. In use, a flow stream is received at a connector of a sprinkler base. Next, the flow stream is conveyed to a rotatable arm, wherein the rotatable arm allows for 360 degree movement in a first axis direction. Additionally, the flow stream is then conveyed to a flexible tubular member connected to a metal coil, wherein the metal coil allows for movement in a second axis direction, and the flexible tubular member is capable of movement in the first axis direction and the second axis direction. Further, the flow stream is conveyed to one or more objects connected to the flexible tubular member and the flow stream is expelled through one or more spray valves attached to each of the one or more objects.

DETAILED DESCRIPTION

Figure 1:
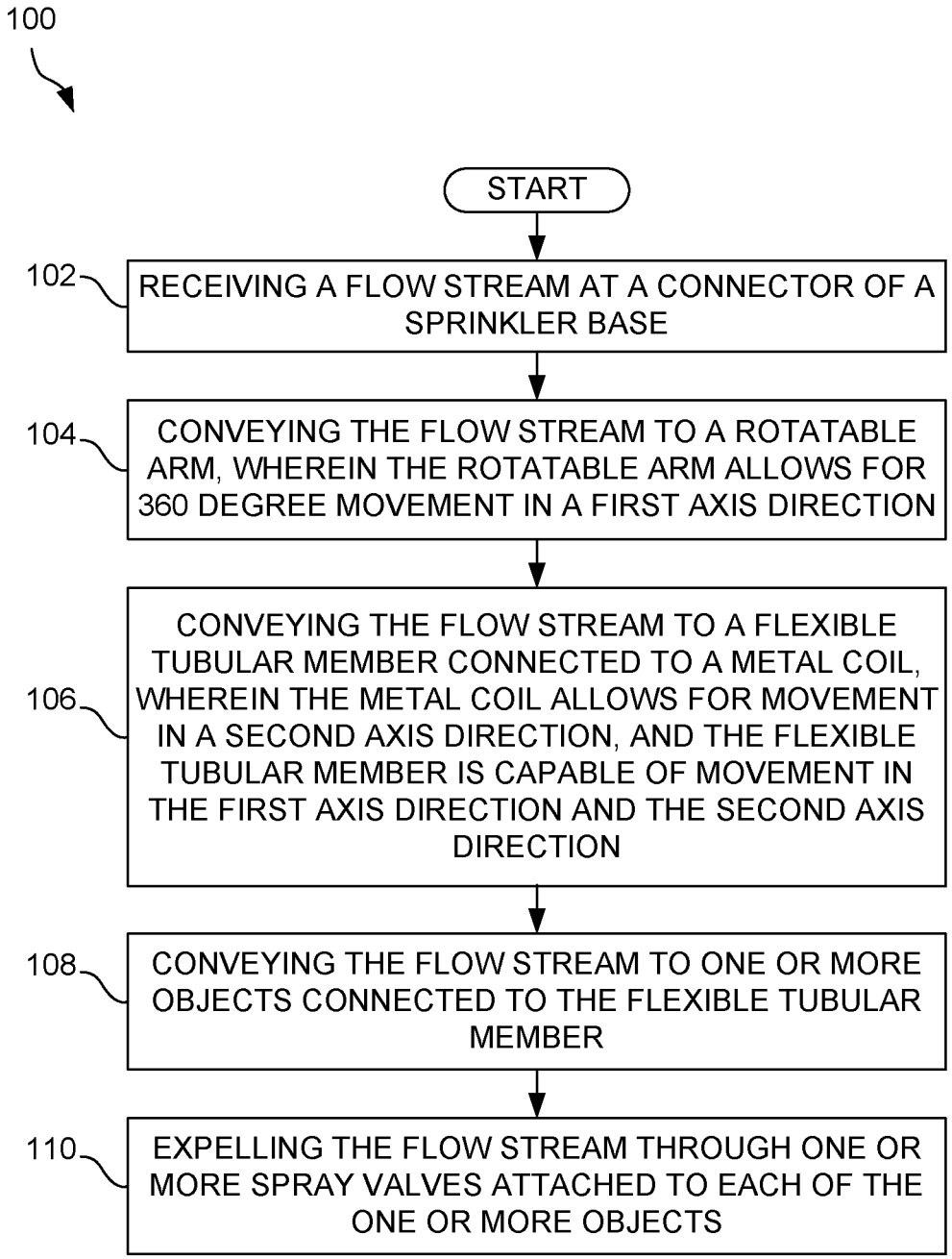
FIG. 1 illustrates a method for using the sprinkler toy, in accordance with one possible embodiment.

FIG. 1 illustrates a method 100 for using the sprinkler toy, in accordance with one possible embodiment.

As shown, the method 100 includes, at 102, receiving a flow stream at a connector of a sprinkler base. Next, at 104, the flow stream is conveyed to a rotatable arm, wherein the rotatable arm allows for 360 degree movement in a first axis direction. Additionally, at 106, the flow stream is conveyed to a flexible tubular member connected to a metal coil, wherein the metal coil allows for movement in a second axis direction, and the flexible tubular member is capable of movement in the first axis direction and the second axis direction.

At 108, the flow stream is conveyed to one or more objects connected to the flexible tubular member. Still yet, at 110, the flow stream is expelled through one or more spray valves attached to each of the one or more objects.

In the context of the present description, a flow stream refers to any fluid which is capable of being directed through the toy sprinkler. Additionally, in the context of the present description, the flexible tubular member may include any tube which is used to convey the fluid. In various embodiments, flexible tubular member may be constructed of polyethylene, polypropylene, or PVC material. Additionally, the flexible tubular member may be between one half to one inch in diameter, although any diameter (based on the input fluid rate) may be used.

In one embodiment, the one or more objects may include a toy. Further, the one or more spray valves may include an ornamental object on one end of each of the one or more spray valves. Additionally, the flow stream may cause the one or more objects (such as the toy) to rise and fall as it is expelled from the one or more spray valves.

The following description of the embodiment(s) is merely exemplary (illustrative) in nature and is in no way intended to limit the invention, its application, or uses. Additionally, the invention may be practiced according to the claims without some or all of the illustrative information.

Figure 2:
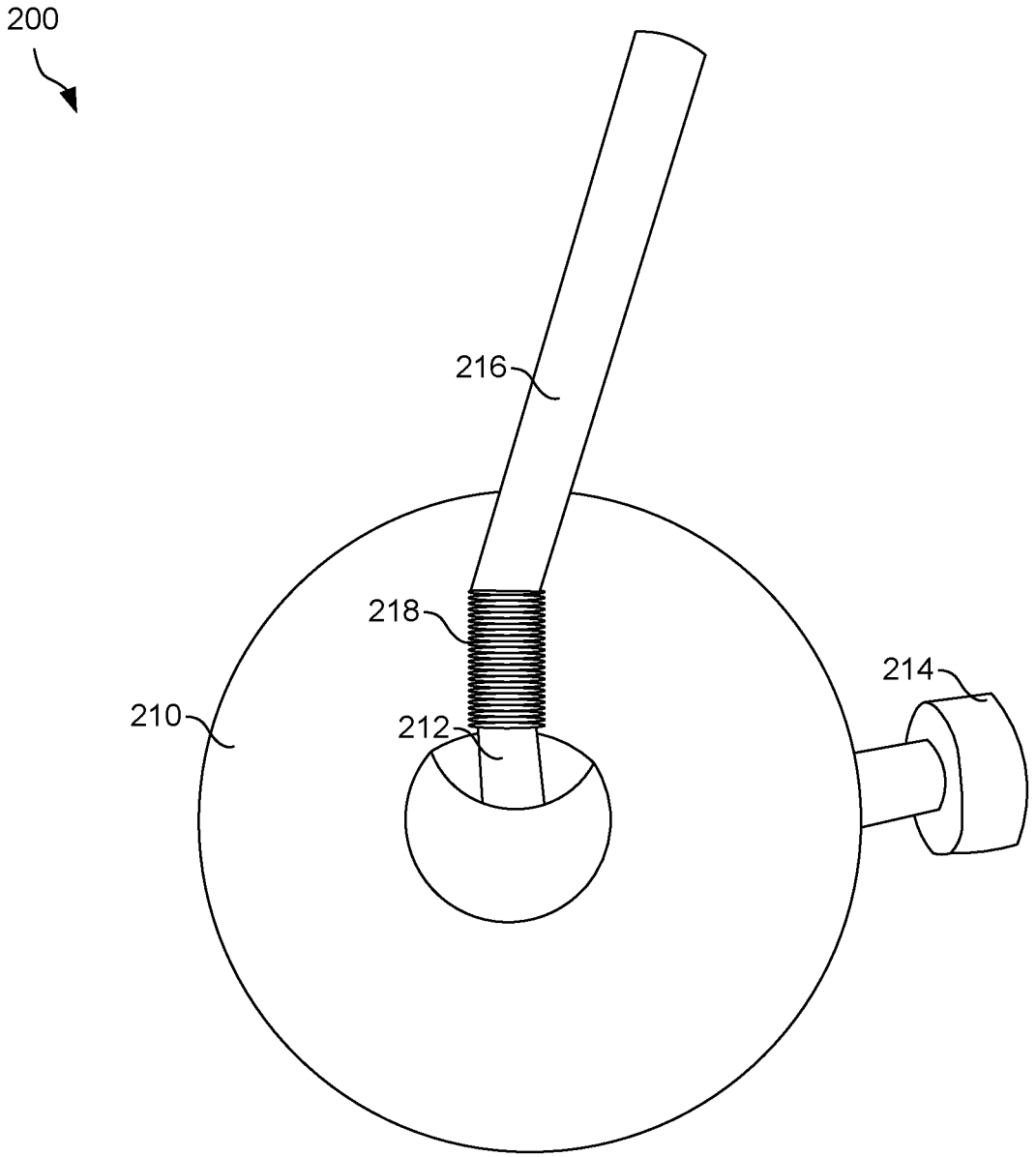
FIG. 2 illustrates a first view of the sprinkler toy, in accordance with one possible embodiment.

FIG. 2 illustrates a first view 200 of the sprinkler toy, in accordance with one possible embodiment. Optionally, the first view 200 may be implemented in the context of any of the foregoing figures.

As shown, the first view 200 depicts a sprinkler base 210 and rotatable arm 212 extending from the sprinkler base 210. A hose connector 214 may be attached to any garden hose, and hose connector 214 may be used to supply water to the sprinkler base 210 and to rotatable arm 212. Additionally, flexible tubing member 216 extends outwardly from the rotatable arm 212. In one embodiment, the flexible tubing member 216 may receive fluid (e.g. water) from rotatable arm 212. Additionally, the flexible tubing member 216 may be secured to rotatable arm 212 via a clamp or any other securing mechanism (not shown).

A metal coil 218 (e.g. spring) may be attached to the rotatable arm 212 and to the flexible tubing member 216. In one embodiment, metal coil 218 may provide additional strength and flexibility to the flexible tubing member 216. In another embodiment, the flexible tubing member 216 may be one-half to one inch in external diameter, and may be made of polyethylene, polypropylene, pvc, or various other common materials.

Additionally, the metal coil 218 may include a spring or any compression spring, and be constructed of one of variety of materials (e.g. stainless steel, music wire, etc.). Further, although the metal coil 218 appears rigid in FIG. 2, it is to be appreciated that metal coil 218 may be flexible and loose such that the flexible tubing member 216 is not held in a rigid vertical position.

Figure 3:
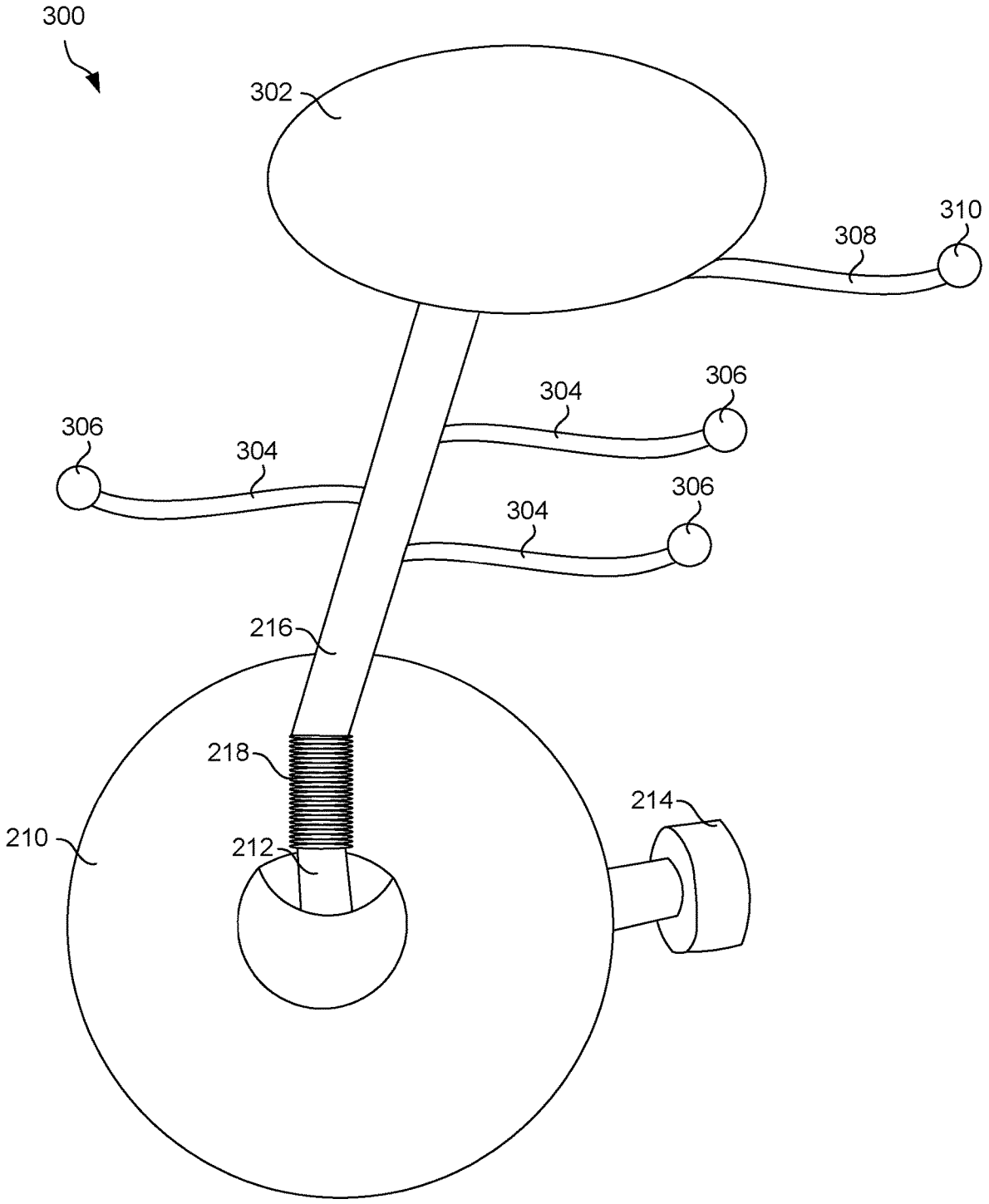
FIG. 3 illustrates a second view of the sprinkler toy, in accordance with one possible embodiment.

FIG. 3 illustrates a second view 300 of the sprinkler toy, in accordance with one possible embodiment. Optionally, the second view 300 may be implemented in the context of any of the foregoing figures.

As shown, second view 300 illustrates the flexible tubular member 216 attached to and extending radially from the rotatable arm 212. At one end of the flexible tubular member 216 is attached toy 302. Toy 302 may be in a shape of an animal (e.g. frog, kangaroo, grasshopper, etc.) or any object (e.g. ball, airplane, etc.). Of course, it is to be appreciated that toy 302 may be in any shape or representation.

In one embodiment, flexible tubes 304 extend from the flexible tubular member 216, and may be used to direct water from the flexible tubular member 216 to ornamental spray objects 306. Such ornamental spray objects 306 may include a spray valve. In like manner, the second flexible tube (or tubes) 308 may extend from toy 302 and may include a ornamental spray object (or spray valve) 310.

In one embodiment, ornamental spray objects 306 (and/or 310) may include insects or any representation through which water (or a fluid) may be projected from flexible tubes 304 (or flexible tube(s) 308).

Figure 4A:
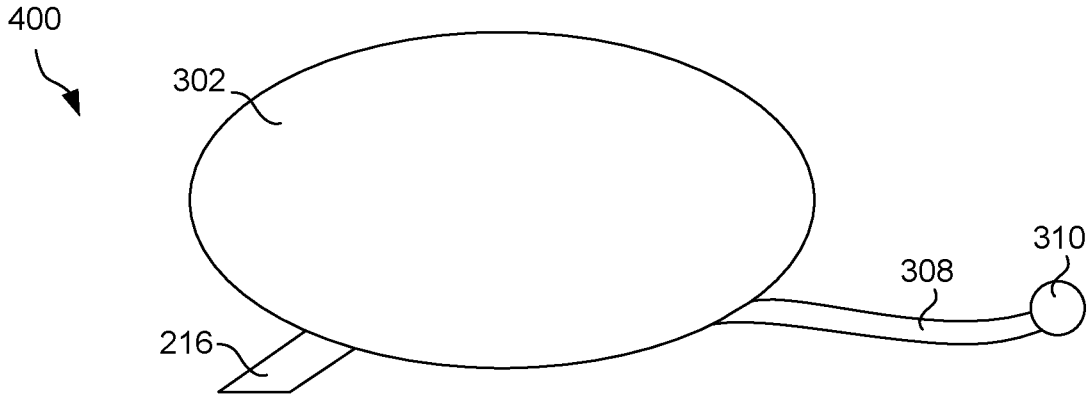
FIG. 4A illustrates a top view of the sprinkler toy, in accordance with one possible embodiment.

FIG. 4A illustrates a top view 400 of the sprinkler toy, in accordance with one possible embodiment. Optionally, the top view 400 may be implemented in the context of any of the foregoing figures.

Figure 4B:
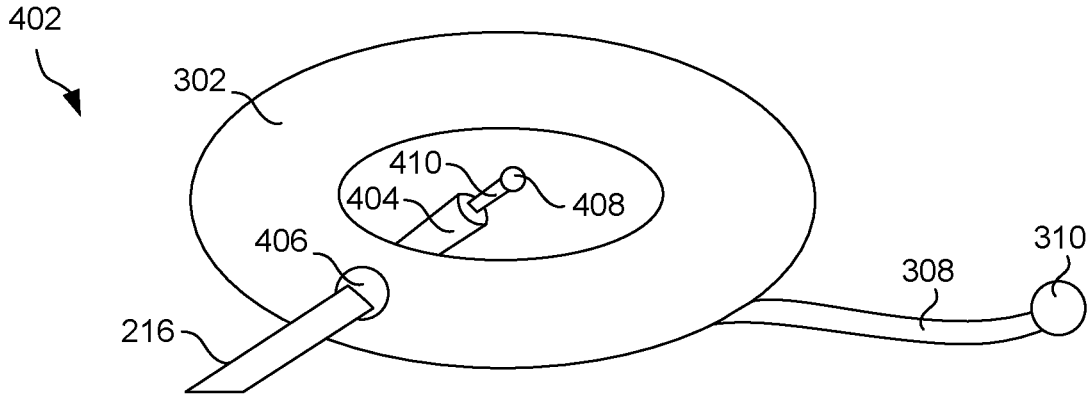
FIG. 4B illustrates a bottom view 402 of the sprinkler toy, in accordance with one possible embodiment.

As shown, top view 400 corresponds with the elements and descriptions of FIG. 3. In contrast, FIG. 4B illustrates a bottom view 402 of the sprinkler toy, in accordance with one possible embodiment. Optionally, the bottom view 402 may be implemented in the context of any of the foregoing figures.

As shown, bottom view 402 includes the toy 302. In one embodiment, the toy 302 may be an inflatable body and may include a valve (e.g. to inflate the toy 302). Elongated spray valve 404 may extends through a channel 406 in toy 302. Additionally, elongated spray valve 404 may be connected to flexible tubular member 216. A connecting tube 410 may be attached at one end of the elongated spray valve 404 such that fluid (e.g. water) entering flexible tubular member 216 may be directed to elongated spray valve 404, and may be continually directed to connecting tube 410 which may be further connected to flexible member 308 via connector 408. In this manner, water may be directed to ornamental spray object (spray valve) 310. Further, elongated spray valve 404, in addition to directing water to connecting tube 410, may also be used to release water and may include one or more spray valves.

In one embodiment, ornamental spray objects (include spray valves) 306 (and/or 310) may be used to provide an intermittent spray of water directed away from the toy 302. Additionally, such spray (e.g. from ornamental spray objects 306, 310 and/or elongated spray valve 404) may be used to direct water downwardly, thereby causing the toy 302 to raise upwards.

In operation, with water being directed and expelled through the system (e.g. via ornamental spray objects 306, 310 and/or elongated spray valve 404), the toy 302 may in turn swivel (via rotatable arm 212) on sprinkler base 210. In one embodiment, the sprinkler base 210 may be removably staked to the ground. In other embodiments, the sprinkler base may move based on the movement of the toy 302 and metal coil 218.

Based on the assembly of such system, the toy 302 may rise each time the water spray is directed towards the ground. By operation of the metal coil 218 (e.g. spring), the toy 302 may move in a random fashion around the sprinkler base 210.

In one embodiment, any number of spray valves may be located on the flexible tubing member 216 and/or the toy 302. For example, a spray valve may be located on top of the toy 302. In this manner, a fluid (e.g. water) may be directed from the toy 302 in more than one direction.

Still yet, the sprinkler base 210 may additional include a sprinkler mat (not shown) which may be used in combination with the sprinkler base such that when a movement of the toy 302 is downward, the toy 302 avoids coming in contact with a ground surface (e.g. a damp lawn surface) but rather in contact with a sprinkler mat, constructed of plastic material (or any similar type material). This interaction (with the sprinkler mat) may allow for better movement (rebound of the metal coil 212) as the surface of the toy 302 may come in contact with a more rigid surface of the sprinkler mat.

In one embodiment, use of a sprinkler mat may allow for water to pool below and around the sprinkler base 210, such that when the toy 302 comes in contact with the sprinkler mat, the contact of the toy 302 on the sprinkler may cause water pooled on the surface of the sprinkler mat to splash upwards.

While specific embodiments of the invention have been described, it is understood that the present invention is not intended to be limited only to such embodiments. Additionally, the scope of the preferred embodiment should be defined by the following claims and their equivalents. Moreover, any combination of the above-described elements in all possible variations thereof is encompassed unless otherwise indicated herein or otherwise clearly contradicted by context. Further, the use of the terms "a" and "an" and "the" and similar referents in the context of describing the subject matter (particularly in the context of the claims) are to be construed to cover both the singular and the plural, unless otherwise indicated herein or clearly contradicted by context. No language in the specification should be construed as indicating any non-claimed element as essential to the practice of the invention as claimed.

What is claimed is:

1. A device, comprising:

a sprinkler base, a rotatable arm connected to a top of the sprinkler base, wherein the rotatable arm allows for 360 degree movement in a first axis direction;

a spring connected to the rotatable arm, wherein the spring allows for movement in a second axis direction;

a flexible tubular member connected to the spring, wherein the flexible tubular member is capable of movement in the first axis direction and the second axis direction;

a toy connected to an end of the flexible tubular member;

an elongated spray valve that extends through a channel in an inflatable body of the toy;

a connecting tube coupled to the elongated spray valve;

a flexible member connected to the toy and connectable to the connecting tube;

an ornamental spray valve coupled to the flexible member;

and a connector for a garden hose for conveying a flow stream, the connector connected to the sprinkler base, wherein the flow stream enters the connector, proceeds to the rotatable arm and then the flexible tubular member, and is expelled via one or more of the elongated spray valve or the ornamental spray valve.

2. The device of claim 1, wherein the one or more objects include a toy.

3. The device of claim 2, wherein the toy includes one or more attachments used to expel water.

4. The device of claim 1, wherein the flow stream causes at least one of the one or more objects to rise and fall.

5. The device of claim 1, further comprising a mat upon which the sprinkler base is placed.

6. The device of claim 1, wherein flexible tubular member is between one-half to one inch in external diameter.

7. The device of claim 1, wherein the flexible tubular member is constructed of one of polyethylene, polypropylene, or PVC material.

8. The device of claim 1, wherein the spring includes at least one of a metal coil or a compression spring.

* * * * *